US010758040B2

(12) United States Patent
Hansson et al.

(10) Patent No.: US 10,758,040 B2
(45) Date of Patent: Sep. 1, 2020

(54) ERGONOMIC WORKSTATION

(71) Applicant: WORKMOTIONS AB, Taby (SE)

(72) Inventors: Jens Hansson, Danderyd (SE); Thor Munck Birkmand, Kopenhamn K (DK)

(73) Assignee: WORKMOTIONS AB, Taby (SE)

( * ) Notice: Subject to any disclaimer, the term of this patent is extended or adjusted under 35 U.S.C. 154(b) by 0 days.

(21) Appl. No.: 16/313,578

(22) PCT Filed: Jun. 15, 2017

(86) PCT No.: PCT/SE2017/050639
§ 371 (c)(1),
(2) Date: Dec. 27, 2018

(87) PCT Pub. No.: WO2018/004422
PCT Pub. Date: Jan. 4, 2018

(65) Prior Publication Data

US 2019/0335896 A1 Nov. 7, 2019

(30) Foreign Application Priority Data

Jun. 28, 2016 (SE) ..... 1650929

(51) Int. Cl.
*A47B 21/02* (2006.01)
*A47B 21/03* (2006.01)
*A47B 9/00* (2006.01)

(52) U.S. Cl.
CPC ..... *A47B 21/02* (2013.01); *A47B 21/0314* (2013.01); *A47B 2009/003* (2013.01);
(Continued)

(58) Field of Classification Search
CPC ..... A47B 21/02; A47B 21/0314; A47B 2200/0078; A47B 2200/0044; A47B 2021/0321; A47B 2009/003; A47B 21/03
See application file for complete search history.

(56) References Cited

U.S. PATENT DOCUMENTS 5,680,820 A 10/1997 Randolph
6,418,860 B1 * 7/2002 Hinderhofer ..... A47B 21/03 108/10

(Continued)

FOREIGN PATENT DOCUMENTS

EP 2 214 528 A 8/2010
WO WO 2007/032739 A1 3/2007
WO WO-2007/032739 A1 3/2007

OTHER PUBLICATIONS

International Search Report and Written Opinion regarding Application No. PCT/SE2017/050639, dated Aug. 25, 2017, 8 pps.

(Continued)

*Primary Examiner* — Hanh V Tran
(74) *Attorney, Agent, or Firm* — Foley & Lardner LLP

(57) ABSTRACT

Workstation for a user (10), in particular intended for a user's (10) keyboard work, the workstation (11) comprising a working surface (12) which is movable in relation to the workstation (11), a motor (16) arranged to drive the working surface (12) of the workstation (11), when the workstation (11) with the working surface (12) thereof is situated on a first lower vertical level (LL), downward and forward from an upper position (UTP) to a lower position (LTPSit) and from said lower position (LTPsit) back to said upper position (UTP) according to a determined length of stroke (42, 43) of a first movement pattern, wherein said motor (16) is adapted to drive said working surface (12) of the workstation (11) when the workstation (11) with the working surface (12) thereof is situated on a second upper vertical level (UL) in a second movement pattern deviating from the first movement pattern.

9 Claims, 2 Drawing Sheets

(52) U.S. Cl.
CPC ..... *A47B 2021/0321* (2013.01); *A47B 2200/0044* (2013.01); *A47B 2200/0078* (2013.01)

(56) References Cited

U.S. PATENT DOCUMENTS 6,474,243 B1 11/2002 Grohse
8,991,320 B2 3/2015 Desroches et al.
9,961,992 B2 * 5/2018 King ..... A47B 21/02
10,092,092 B2 * 10/2018 Koch ..... G06F 3/011
10,376,158 B2 * 8/2019 Desroches ..... A61B 5/0205
10,448,733 B2 * 10/2019 Feeley ..... A47B 21/02
2004/0256524 A1 * 12/2004 Beck ..... A47B 21/0314 248/146
2005/0022699 A1 * 2/2005 Goza ..... A47B 21/0314 108/50.01
2005/0275322 A1 * 12/2005 Mosel ..... A47B 9/20 312/312
2006/0075933 A1 * 4/2006 Ohlson ..... A47B 21/02 108/10
2008/0173777 A1 * 7/2008 Yamamoto ..... A47B 21/0314 248/274.1
2009/0095868 A1 * 4/2009 Ohlson ..... A47B 21/02 248/371
2010/0148647 A1 * 6/2010 Burgess ..... A47B 21/00 312/327
2012/0248263 A1 * 10/2012 Grotenhuis ..... A47B 21/02 248/123.2
2013/0126682 A1 * 5/2013 Tholkes ..... F16M 11/046 248/125.8
2013/0200579 A1 * 8/2013 Abernethy ..... B62B 3/02 280/6.15
2014/0096706 A1 * 4/2014 Labrosse ..... A47B 21/02 108/21
2014/0137773 A1 * 5/2014 Mandel ..... G06Q 10/109 108/50.11
2014/0208986 A1 * 7/2014 DesRoches ..... A47B 9/20 108/22
2015/0201747 A1 * 7/2015 Blackburn ..... A47B 21/0314 108/5
2016/0058186 A1 * 3/2016 Liu ..... F16M 11/10 700/275
2016/0088931 A1 * 3/2016 Schneider ..... A47B 21/03 108/28
2016/0231731 A1 * 8/2016 Carver ..... A47B 21/00
2018/0064244 A1 * 3/2018 Tsai ..... A47B 41/02

OTHER PUBLICATIONS

European Extended Search Report for Application No. 17820541.3 dated Oct. 11, 2019, 7 pps.

* cited by examiner

ERGONOMIC WORKSTATION

TECHNICAL FIELD

The present invention relates to workplaces having workstations at which staff are working with office work, in particular keyboard work at computers.

BACKGROUND OF THE INVENTION

The number of persons who at their work are sitting still and maybe in particular are using a computer increases continually and likewise the number of hours that these persons are spending sitting increases. Since the human body is not made for pure static work, this type of work leads increasingly not only to the one performing the work being uncomfortable, but lesions, such as muscular pain and osteoarthritis, may also arise. The reasons for these lesions are presumably at the time of writing not entirely investigated, but one of the factors is considered to be the impaired circulation of the blood in statically contracted muscles.

To improve ergonomics at sitting work, through the years there have been presented many constructions intended to afford good setting possibilities so that the workplaces should be possible to be adapted according to exactly the person who should use it. In order to avoid or at least decrease the purely static work with, for instance, holding up the arms at keyboard work, particular wrist supports have been constructed (U.S. Pat. No. 5,158,256). To improve the circulation, furniture with a built-in capacity of continuous small movements has in addition been constructed so that the working position is varied, for instance by means of motor operation (U.S. Pat. No. 6,296,408).

By the Swedish patent SE 529025, a workstation intended for computer keyboards is previously known, which workstation comprises a movable working surface that is driven by a motor in a continuous movement downward forward from an upper position to a lower position and back to the upper position.

THE OBJECT OF THE INVENTION

The object of the invention is to further develop a workstation by integrating a sitting workplace with a standing workplace and for these provide adapted movement patterns of the working surface of the workstation.

A further object is that such movement patterns can be adapted according to the vertical level of the workstation.

In addition, the object of the invention is that such a developed workstation is connected to a control unit by which the movements of the working surface can be determined and manoeuvred.

SUMMARY OF THE INVENTION

By the present invention, as this appears in the independent claim, the above-mentioned objects are met, wherein said disadvantages have been eliminated. Suitable embodiments of the invention are defined in the dependent claims.

The invention concerns a workstation, in particular intended for keyboard work, the workstation comprising a working surface which is movable in relation to the workstation. Said working surface constitutes a part of the other working surface of the workstation but the first-mentioned one is movable in relation to the stationary other working surface. A motor is arranged to drive the movable working surface of the workstation, when the workstation with the working surfaces thereof is situated on a first lower vertical level, downward and forward from an upper position to a lower position and from said lower position back to said upper position according to a determined length of stroke of a first movement pattern. In addition, said motor is adapted to drive said movable working surface of the workstation when the workstation with the working surfaces thereof is situated on a second upper vertical level in a second movement pattern deviating from the first movement pattern. In this connection, the same motor may be adapted to in addition drive the workstation between said lower level and said upper level. Also embodiments which comprise a plurality of motors, each one of which is adapted to specific movements, are comprised by the invention. For instance, a first motor may be adapted to drive the workstation between said lower level and said upper level, a second motor be adapted to drive the working surface according to a first movement pattern on the lower level of the workstation, and a third motor be adapted to drive the working surface according to a second deviating movement pattern on the upper level of the workstation.

The movement pattern of the movable working surface comprises maximum four reciprocating movements, viz. one vertical position change, one horizontal, forwardly directed position change, one horizontal, lateral position change, and one angular movement. In each movement pattern, there are included at least one measure of vertical position change and/or one measure of horizontal position change. In addition, in other movement patterns, there may be included an angular change to a certain extent. The magnitude of the four movements can be individually determined for each selected movement pattern.

In one embodiment of the invention, the length of stroke of the movement of the working surface on the second upper vertical level of the workstation is smaller than the length of stroke of the movement of the working surface on the first lower vertical level of the workstation. The length of stroke comprises the horizontal length of stroke and/or the vertical length of stroke.

In one embodiment of the invention, the motor is arranged to drive the working surface continuously in a reciprocating movement, horizontal and/or vertical. Such a continuous movement entails that the elbow joints and the shoulders of a user will continuously be the subject of an angular change during the movement of the working surface.

In one embodiment of the invention, the working surface is in addition arranged to simultaneously, on one hand, be angled in the direction from the user when the working surface moves from the user and, on the other hand, be angled toward the user when the working surface moves toward the user.

In one embodiment of the invention, at least two movements are coupled to each other, which entails that they take place simultaneously.

In one embodiment of the invention, the movable working surface is suspended in swinging arms.

In one embodiment of the invention, the arm lengths are variable for the swinging arms, which entails that the movements can be controlled by force.

In one embodiment of the invention, the movable working surface or a part thereof is displaceable laterally for adjustment and/or for driven lateral movement.

In one embodiment of the invention, the movements of the working surface are software-controlled and can be controlled via a control unit.

The invention contributes to improving the conditions for a previously sedentary work using a movable working surface with the movement variation obtained by the fact that also a movement pattern of the movable working surface is determined for a standing work at the workstation. The continuous change of the working position using hitherto present devices has been relatively small and in this way the movements do not become sufficiently dynamically optimized to improve the circulation of the blood as much as is required to decrease the risk of, among other things, muscular pain and simultaneously avoid discomfort such as, for instance, dizziness in other working postures than sitting. Against this background, the invention has the function to provide a device that affords the workstation to be used for standing work and in that connection offer a specially adapted movement pattern at standing work. By movement of the joints and muscles of the upper limbs also at standing work, an improved circulation of the blood is allowed also during said standing part of the execution of the work without needing to waive the well-being and productivity of the users in other respects.

In accordance with the invention, this task is solved by the fact that the work table, or a part thereof, for instance a working surface which supports a keyboard, is arranged movable along a movement path which extends downward forward from the user. This movement path is also offered at standing work but according to a deviating movement pattern. In addition, the movement path can be coupled to the inclination of the work table or the keyboard so that an angulation in the direction of movement simultaneously may be effected.

By arranging the working surface for a workstation in any one of the ways described above, the working surface can, in particular when it applies to keyboard work, be moved a relatively long distance from the body and toward the same, respectively, also at standing work without the work becoming uncomfortable. The ranges of angles within which hands and fingers work optimally can be maintained at the same time as arms and shoulders can make relatively large movements, which affords a considerably improved circulation of the blood and the corresponding improved comfort and well-being.

In the invention, for further improving the mobility during work, the keyboard may during work also be moved laterally to and fro.

Within the scope of the invention, motor operation is conceivable by means of cams, levers, et cetera. Alternatively, it is conceivable that the working surface in combination with the above mentioned motor operation is movable along a guide that is spring biased toward the user so that the he/she can press away the working surface himself/herself and that the working surface then slowly returns, which, for instance, may take place by the use of an air cylinder and a spring. The end positions can be determined by means of suitable stops or by the length of stroke of the motor device. The angulation movement of the leaf may also be provided with end position stops and may be effected at the same frequency as of the leaf or by another pace. Furthermore, the movements of the working surface may be software-controlled.

The present invention concerns an extension of previously known functions regarding the movement pattern of the working surface. A coupling is made according to the present invention between the sitting or standing position of the user and the movement pattern of the movable plate. The vertical location in sitting position or standing position of the vertically adjustable desk, in which the movable working surface is mounted, determines which length of stroke that the movement cycle of the keyboard plate, i.e., of the working surface, of the workstation should have. By shifting from sitting to standing, the length of stroke of the movable working surface is changed by decreasing, for instance, an absolute length in cm or a percentage of the total length of stroke, and conversely when going from standing to sitting, the length of stroke is changed by being scaled up again, so that the length of stroke becomes the same as in the preceding use in the sitting position. These movement patterns of the working surface of a workstation are controlled via a programmed software. The sitting position and the standing position, respectively, of the workstation are adjusted depending on the physical constitution of the user either manually or automatically by a camera, or another optical measuring equipment, recording the length of the user when the user has placed himself/herself at the workstation.

Users generally have a tendency to lean more toward the table when they are standing up so as to somewhat get support and/or find balance, and in particular often the wrists are used as support. Therefore, the body movement is altered in relation to the movable working surface, consciously or unconsciously, when one is standing, since the user may come to lean somewhat inward over the desk when the movable working surface moves downward and then may come to move outward again when the movable working surface moves upward. If the posture of the upper part of the body is changed because of the user getting support against the movable plate, the visual angle between eye and screen will also be changed and this may give rise to lighter dizziness. By shortening the length of stroke of the movement pattern in use in standing posture, this undesired balance effect can be suppressed. It is also feasible to be able to provide the alteration of length of stroke by one or more keystrokes on a control panel, instead of letting this be controlled automatically based on the set height of the desk.

Within the scope of the invention, there is also included that a user has the possibility to vary the speed of the movable working surface, so as to, in such a way, be able to increase or decrease the number of movement cycles completed per unit of time. This function is based on a greater quantity of completed cycles per unit of time affording a stronger rehabilitating as well as preventive effect up to a breaking point, when the speed becomes so high that it turns to be a physiological load.

The workstation with the movable working surface thereof is also provided with functions for decreased electricity consumption by the usage of a presence sensor, which may be of the type capacitive, IR, light beam, etc. Alternatively, this presence sensor may be a micro switch under a wrist having the switch included in the movable working surface to generate a "dead man's grip", which switch also works as power switch for decreased consumption of electricity. Also sensors which offer child protection or surveillance in the vicinity of movable mechanical parts could be relevant additions.

Further functions of the workstation are to use a mobile phone based so-called app, application program, having Bluetooth function which senses if a user is in the vicinity and, if not, turns off the workstation. This function may also be provided by a RFID hand unit, for instance formed as a key-ring or in another way. For instance, a timer may be coupled to a "Play" button with determined length of time so as to then command turning off.

Further functions of the workstation are an improved working space by the fact that a sensor senses the legroom by a legroom sensor which adapts the height of the workstation to the current sitting position of a person. A further alternative function is that an auxiliary button of the operating device of the workstation, membrane keyboard, makes that a desk having an integrated workstation with a movable working surface can be brought to conform to the requirements of relevant standard specifications, for instance EN527-1, as regards, for instance, vertical legroom.

Within the scope of the invention, a functionality is also included to individualize the use of the ergonomic workstation, for instance by automatically setting, via Bluetooth, app-based, RFID, hardware-based, or another communications link, the parameters of the workstation for the movement pattern thereof such as speed of movement, upper and lower turning position, etc. Also an individualization and the appurtenant control of the parameters of the electrically vertically adjustable table stand, primarily height, is embraced by the invention.

Further ideas within the scope of the invention are alternative drivings and mechanical controls of the movable plate of the workstation. For instance, linear motor or stepping motor operation is used as well as rail guide instead of, as previously, link levers.

Additional fields of application of the present invention are at checkouts in a self-service store, monitoring centres of power stations, machine operator stations of manufacturing companies, driver's cabs in commercial vehicles, such as, for instance, forest machines, etc.

BRIEF DESCRIPTION OF THE DRAWINGS

Now, the invention will be described in more detail, references being made in connection with the accompanying drawing figures.

DESCRIPTION OF THE INVENTION

Figure 1:
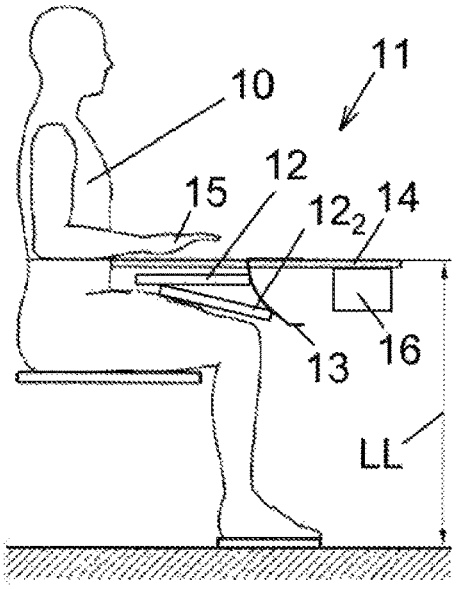
FIG. 1 schematically shows a workstation on a lower level according to an embodiment of the invention.

FIG. 1 schematically shows a sitting user 10 at a workstation 11 on a first lower vertical level LL. The workstation 11 is provided with a movable working surface 12, which is movable at least downward and forward from an upper position to a lower position and from said lower position back to said upper position according to a determined length of stroke of a movement path of a first movement pattern. The working surface constitutes a part of a support base, usually a tabletop on which for instance a keyboard and a mouse may be placed, which perform the movement pattern which will be described in the following. With "working surface", reference is henceforth accordingly made also to the base that comprises the working surface. The working surface 12 is in its top position situated flush with the surface of the stationary tabletop 14 of the workstation 11. The working surface 12 in the figure is shown in two positions according to a selected movement pattern wherein the working surface 12 in the shown upper position has moved downward and forward from the level of the table face. In the shown lower, second position in the figure, the working surface 122 has moved further downward and forward from the level of the table face and has also been angled 15° away from the user 10. The workstation 11 is provided with a front means 13 formed as a metal sheet, which eliminates the arisen gap between the stationary table 14 of the workstation 11 and the movable working surface when this is moving downward. The purpose of the front means is primarily to avoid crushing injuries but also to prevent the keyboard from falling off the movable working surface. The table is preferably provided with a retraction arranged in the edge of the table and in this, a smaller leaf is fitting with said working surface 12, which leaf with working surface is movable in a path that extends downward and in under the table, i.e., from the user. The leaf with the working surface 12 is suspended on the underside of the table in swinging arms attached to a bracket, not shown. The figure also shows a motor 16 which in the embodiment illustrated is placed on the underside of the table 14 and intended to drive the working surface 12 according to a preselected movement pattern.

Independently of the angle position or the extent of projection of the leaf, the angle between the hand and the leaf can be retained. This means that the hands 15 of the user, during the entire movement path of the working surface 12, can retain the position thereof in relation to, for instance, a keyboard and possibly the appurtenant support at the same time as the wrist is working at different angles in relation to the forearm. In this way, parts of the musculoskeletal system, for instance the tendons that connect the fingers with the appurtenant muscles, will obtain a superimposed movement.

Also the elbow joint and the shoulder obtain continuous angular changes during the motor driven movement of the leaf backwards and forwards between the positions shown in FIG. 1.

Figure 2:
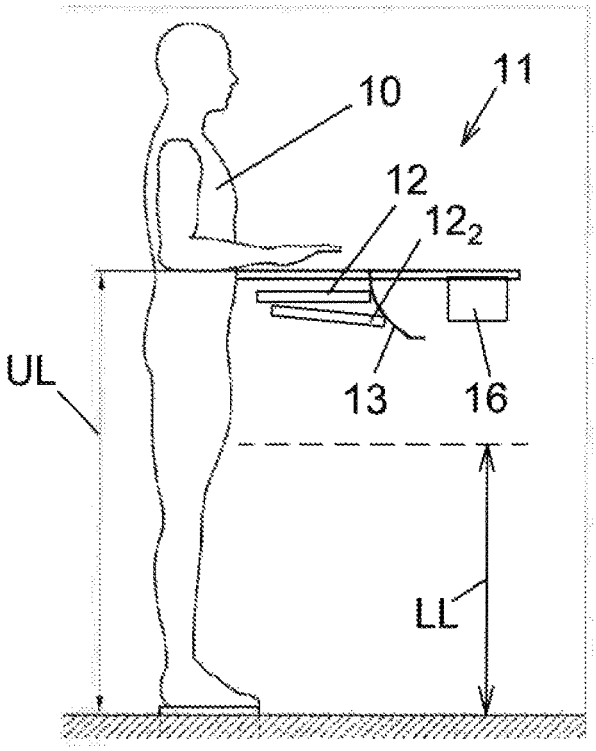
FIG. 2 schematically shows a workstation on an upper level according to an embodiment of the invention.

FIG. 2 shows the workstation 11 on an upper vertical level UL, which corresponds to a standing workplace for a user 10. On this upper level UL, the movement path is identical to the movement path of the lower level LL, indicated by a dashed line, but the movement pattern is however different. In the figure, this movement pattern is shown as the working surface 12 in the shown upper position having moved downward and forward from the level of the table face. In the shown lower position, the working surface 122 has moved further downward and forward from the level of the table face but, however, not as far downward as when the workstation with the working surface thereof is situated on the first lower vertical level according to FIG. 1. Within the scope of the invention, also the movement path may be deviating between the two levels shown, for instance that the working surface in the sitting position according to FIG. 1 moves further in under the table than in the standing position according to FIG. 2. In such an embodiment having deviating movement paths, the front means 13 is manufactured from a resilient material, for instance plastic or rubber, or replaced by safety equipment for avoiding risk of crushing. The movement pattern according to FIG. 2 has an angulation of the working surface 12 that is smaller than its angulation in FIG. 1.

Thus, the working surface 12 has a movement pattern deviating from the first movement pattern according to FIG. 1 when the workstation 11 is situated on a second upper vertical level UL according to FIG. 2. FIG. 2 also shows that the length of stroke of the movement of the working surface 12 on the second upper vertical level UL of the workstation 11 is shorter than the length of stroke of the movement of the working surface 12 on the first lower vertical level LL of the workstation 11. The motor 16 may also be adapted to a driving of the workstation with the working surface thereof between the first lower vertical level LL and the second upper vertical level UL. The movement path defines the horizontal and vertical move of the working surface while the movement pattern comprises the movement path, the upper and lower positions of the movement path and the angulation of the working surface.

The leaf with the working surface 12 is also movable laterally, which may be effected in its own pace alternatively synchronized with some one of the other movements. Instead of letting the entire leaf move laterally, it is conceivable that a part of the leaf is movable laterally and intended to support a keyboard, not shown in more detail. By the lateral movement of the keyboard, it is guaranteed that the reciprocating movement of the arms does not take place along exactly the same path each time, which additionally decreases the risk of wear, at the same time as the blood supply is improved. This lateral movement may also comprise an angular movement of the working surface.

The motor driven movement or movements does/do not have to follow the same cycle all the time but the length of stroke and the turning-points may be varied in time by, for instance, reversal of the direction of rotation of the motor. The variation may also be effected randomly.

Instead of motor operation, it is conceivable that the user presses the table from himself/herself against the action of a spring. It is also conceivable that the table in addition to the motor driving also has a limited resilience.

The desirable movements and the movement ranges, respectively, may also be provided using other movement elements than those described above, for instance co-operating linear controls or rotary motors acting directly on relevant shafts, admitting varying movement paths.

By the fact that a static working posture is avoided, the work also becomes more comfortable and less tiring.

Figure 3:
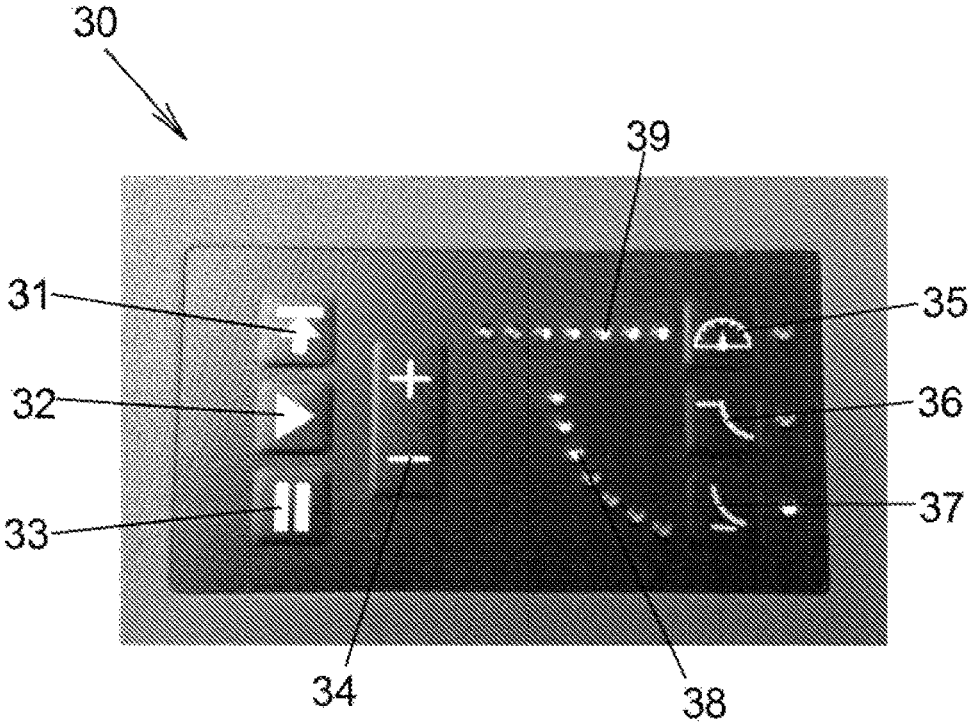
FIG. 3 shows a control panel of the workstation.

FIG. 3 shows an embodiment of a control panel 30 to control and program the movements of the working surface. The control panel 30 is provided with home level button 31 by which the vertical level of the workstation returns to the upper level thereof and the panel is shut off. A start button 32 regulates the continuous movement of the workstation. A pause button 33 is used to stop the movements of the workstation. In addition, a parameter adjustment button 34 is arranged to increase and decrease, respectively, +/−, speeds and positions and possibly angles of the working surface. The control panel 30 is furthermore provided with setting buttons 35, 36, 37 one speed button 35 of which regulates the speed of movement of the working surface and a top position button 36 for a determination of the upper turning position, UTP, of the working surface as well as a bottom position button 37 for a determination of the lower turning position, LTP, of the working surface. These setting buttons are used together with the +/−button 34 to indicate selected position, which is displayed on a stroke length indicator 38. Correspondingly, the +/−button 34 is used together with the speed button 35 to indicate selected speed on a speed indicator 39. The indicators for length of stroke and speed are formed as light emitting diodes.

Within the scope of the invention, a further embodiment could be mentioned for a control panel which also can regulate the extent of the angular change of the working surface and the distance within which the angular change should be effective.

Figure 4:
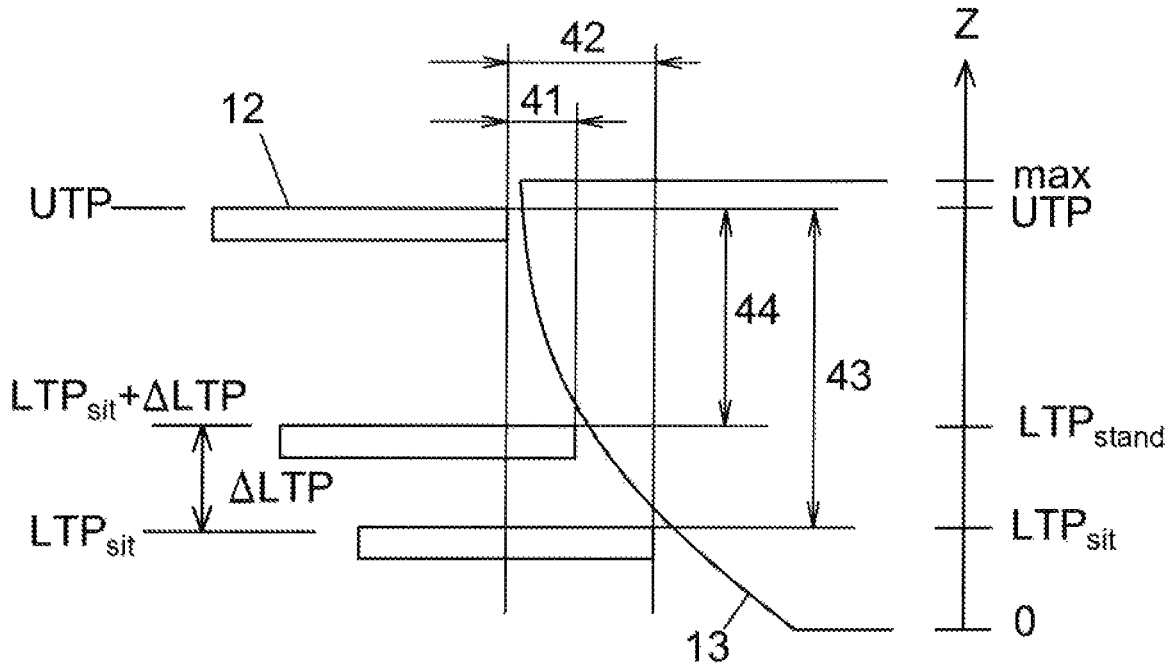
FIG. 4 shows a first movement pattern of the working surface.

FIG. 4 shows a first movement pattern of the working surface wherein the upper turning position, UTP, of the working surface 12 is situated near the maximal upper position, which is indicated on the Z-axis. In case the workstation is situated on an upper vertical level, which corresponds to a standing workplace, the working surface 12 will move downward and forward, i.e., in a direction away from the user, from the upper turning position, UTP, to the lower turning position, $LTP_{stand}$, and from said lower turning position back to said upper turning position according to a determined horizontal and vertical length of stroke of this first movement pattern. The horizontal length of stroke 41 is equivalent to the horizontal move of the working surface 12. As seen in the figure, the working surface is held essentially horizontal during the entire movement, which generally is equivalent to the curvature of the front means 13. The vertical length of stroke is $UTP\text{-}LTP_{stand}$ according to the figure.

In case the workstation is situated on a lower vertical level, which corresponds to a sitting workplace, see FIG. 1, the working surface 12 will also move downward and forward, i.e., in a direction away from the user, from the upper turning position, UTP, to the lower turning position, $LTP_{sit}$, and from said lower turning position back to said upper turning position, UTP, according to a determined horizontal and vertical length of stroke of this first movement pattern. This movement is defined as a movement cycle of the working surface 12. As seen in FIG. 4, the horizontal length of stroke 42 in the sitting position is longer than the horizontal length of stroke 41 in the standing position. In addition, the vertical length of stroke 43 in the sitting position, $UTP-LTP_{sit}$, is longer than the vertical length of stroke 44 in the standing position $UTP-LTP_{stand}$, which is $LTP_{sit.}+\Delta LTP$.

The movements of said first movement pattern may be continuous or be intermittent and in which latter case the movement is stopped after a certain number of cycles and after that is restarted after a determined lull period and continues in the same intermittent way. A stop may also take place within a movement cycle.

Figure 5:
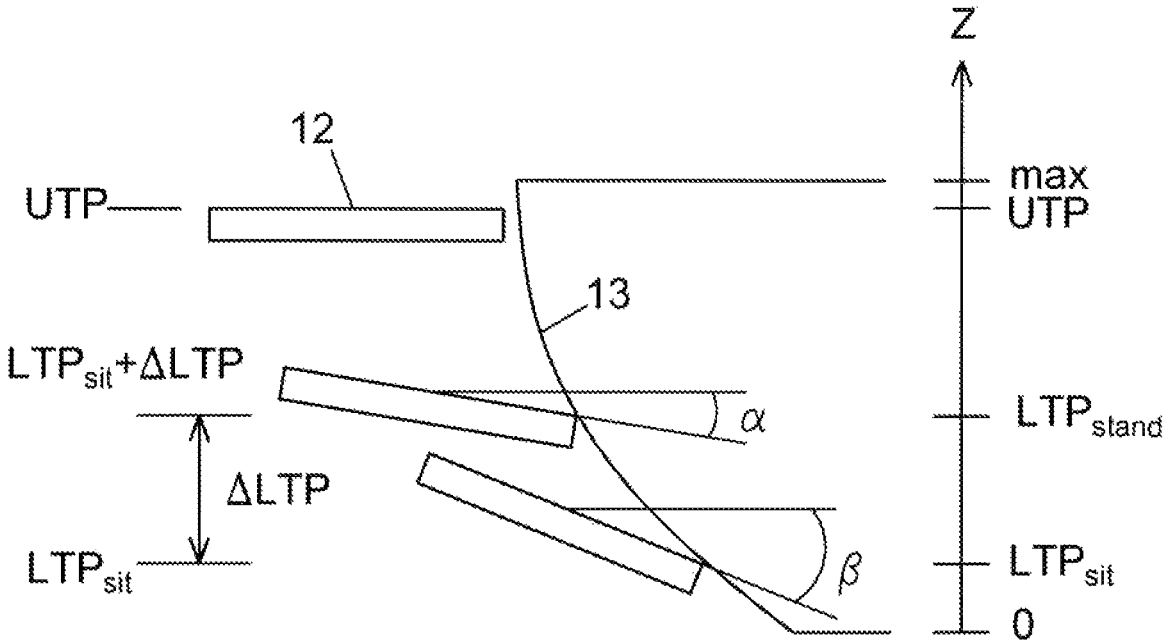
FIG. 5 shows a second movement pattern of the working surface.

FIG. 5 shows a second movement pattern of the working surface 12 wherein the front edge thereof moves along the front means 13. According to this second movement pattern, the working surface 12 will also undergo an angular rotation, which in the lower turning position of the sitting position, $LTP_{sit}$, assumes the value $\beta$ from it in the upper turning position, UTP, having been 0° or near 0°. In a similar way, the working surface 12 in the lower turning position of the standing position, $LTP_{stand}$, will undergo an angular rotation, which assumes the value $\alpha$ from it in the upper turning position, UTP, having been 0° or near 0°. As seen in the figure, usually $\alpha<\beta$.

For possible embodiments, $0°\leq\alpha 20°$ applies, preferably 10° and that $0°\leq\beta\leq 35°$, preferably 20°.

Thus, $\alpha=0$ and $\beta=0$ for the first movement pattern shown in FIG. 4 while the angles for the second movement pattern shown in FIG. 5 assumes angles different from 0.

Also a third movement pattern wherein the working surface in the position in $LTP_{stand}$ has $\alpha=0$ while the working surface in the position $LTP_{sit}$ has $\beta\neq 0$ and for instance assumes the value 20°.

Correspondingly, a fourth movement pattern can be identified wherein the working surface in the position in $LTP_{stand}$ has $\alpha\neq 0°$ and for instance assumes the value 10° while the working surface in the position $LTP_{sit}$ has $\beta=0$.

The invention claimed is:

1. A workstation, comprising:

a working surface movable in relation to the workstation, a motor configured to drive the working surface, and a control unit configured to control the motor to:

continuously drive the working surface, when the workstation is situated on a first lower vertical level, in a reciprocating movement downward and forward from an upper position to a lower position and from said lower position back to said upper position according to a first movement pattern in which the working surface moves with a predetermined length of stroke, and continuously drive said working surface, when the workstation is situated on a second upper vertical level, in a reciprocating movement according to a second movement pattern deviating from the first movement pattern and having at least one measure of vertical position change or one measure of horizontal position change.

2. The workstation of claim 1, wherein the length of stroke of the movement of the working surface on the second upper vertical level is smaller than the length of stroke of the movement of the working surface on the first lower vertical level.

3. The workstation of claim 1, wherein the working surface or a part thereof is displaceable laterally for at least one of adjustment or for driven lateral movement.

4. The workstation of claim 1, wherein the working surface is angled away from a user when the working surface is moving away from the user and is angled toward the user when the working surface is moving toward the user.

5. The workstation of claim 4, wherein the maximal angle movement $\alpha$ on the first lower vertical level is $0° \leq \alpha \leq 20°$.

6. The workstation of claim 4, wherein the maximal angle movement $\beta$ on the second upper vertical level is $0° \leq \beta \leq 35°$.

7. The workstation of claim 1, wherein the movement downward and the movement forward of the first movement pattern take place simultaneously.

8. The workstation of claim 4, wherein the maximal angle movement $\alpha$ on the first lower vertical level is 10°.

9. The workstation of claim 4, wherein the maximal angle movement $\beta$ on the second upper vertical level is 20°.

* * * * *